US009534835B2

(12) United States Patent
Laible et al.

(10) Patent No.: US 9,534,835 B2
(45) Date of Patent: Jan. 3, 2017

(54) REFRIGERATING DEVICE WITH TELESCOPIC EXTENSION

(75) Inventors: Karl-Friedrich Laible, Langenau (DE); Frank Placke, Bielefeld (DE); Claudia Rupp, Neresheim (DE); Matthias Stahl, Schloβ Holte-Stukenbrock (DE); Helmut Steichele, Lauingen (DE); Ulrich van Pels, Rheda-Wiedenbrück (DE)

(73) Assignee: BSH Hausgeräte GmbH, Munich (DE)

( * ) Notice: Subject to any disclaimer, the term of this patent is extended or adjusted under 35 U.S.C. 154(b) by 1326 days.

(21) Appl. No.: 12/525,561

(22) PCT Filed: Jan. 21, 2008

(86) PCT No.: PCT/EP2008/050640
§ 371 (c)(1),
(2), (4) Date: Aug. 3, 2009

(87) PCT Pub. No.: WO2008/095763
PCT Pub. Date: Aug. 14, 2008

(65) Prior Publication Data

US 2010/0019641 A1 Jan. 28, 2010

(30) Foreign Application Priority Data

Feb. 6, 2007 (DE) ..... 10 2007 006 611

(51) Int. Cl.

| | |
|---|---|
| ***F25D 23/02*** | (2006.01) |
| ***F25D 23/00*** | (2006.01) |
| ***F25D 25/02*** | (2006.01) |
| ***A47B 88/04*** | (2006.01) |

(52) U.S. Cl.
CPC ..... *F25D 25/025* (2013.01); *A47B 88/0422* (2013.01); *F25D 25/024* (2013.01)

(58) Field of Classification Search
CPC ... F25D 25/025; F25D 25/024; A47B 88/0422
USPC ..... 312/330.1, 334.1, 334.7, 334.8, 348.1, 312/350, 402, 404; 384/22, 20
See application file for complete search history.

(56) References Cited

U.S. PATENT DOCUMENTS

| | | | | |
|---|---|---|---|---|
| 4,427,245 | A * | 1/1984 | Litchfield et al. | 312/330.1 |
| 5,015,047 | A * | 5/1991 | Nock | 312/334.11 |
| 5,180,217 | A * | 1/1993 | Lautenschlager | 312/334.7 |
| 5,492,400 | A * | 2/1996 | Rock | 312/331 |
| 5,494,348 | A * | 2/1996 | Grabher | 312/348.1 |
| 6,217,139 | B1 * | 4/2001 | Henriott et al. | 312/334.5 |
| 6,428,128 | B1 * | 8/2002 | Henriott et al. | 312/334.12 |

(Continued)

FOREIGN PATENT DOCUMENTS

| | | | | |
|---|---|---|---|---|
| WO | WO 2006037419 A1 * | 4/2006 | | A47B 88/00 |
| WO | 2006120056 A1 | 11/2006 | | |

(Continued)

*Primary Examiner* — Daniel J Troy
*Assistant Examiner* — Ryan A Doyle
(74) *Attorney, Agent, or Firm* — Michael E. Tschupp; Andre Pallapies

(57) ABSTRACT

A refrigerating device is provided that includes a body, a door and a carrier for refrigerated products, the carrier being supported on adapters anchored on movable rails of telescopic extensions and displaceable between an inserted and a pulled-out position. The movable rails of the telescopic extensions are hidden under a tray and the tray of each telescopic extension is clamped between the movable rail thereof and the adapter anchored thereon.

13 Claims, 2 Drawing Sheets

(56) References Cited

U.S. PATENT DOCUMENTS

| | | | | |
|---|---|---|---|---|
| 6,478,393 | B2 * | 11/2002 | Kim et al. | 312/334.12 |
| 6,499,818 | B2 * | 12/2002 | Brustle | 312/319.1 |
| 6,971,730 | B2 * | 12/2005 | Koons | 312/404 |
| 7,240,980 | B2 * | 7/2007 | Koons | 312/404 |
| 2004/0108797 | A1 * | 6/2004 | Chen et al. | 312/334.7 |
| 2005/0088069 | A1 * | 4/2005 | Greenwald et al. | 312/333 |
| 2005/0127683 | A1 * | 6/2005 | Nam | 292/96 |
| 2005/0160854 | A1 | 7/2005 | Rotter | |
| 2006/0033410 | A1 * | 2/2006 | Koons | 312/404 |
| 2006/0266070 | A1 | 11/2006 | Ertz et al. | |
| 2007/0035221 | A1 * | 2/2007 | Koo | 312/404 |
| 2008/0203875 | A1 * | 8/2008 | Lim et al. | 312/404 |
| 2009/0079312 | A1 | 3/2009 | Laible | |
| 2010/0019637 | A1 * | 1/2010 | Guttinger | 312/334.5 |

FOREIGN PATENT DOCUMENTS

| | | | | | |
|---|---|---|---|---|---|
| WO | WO 2006120065 | A1 * | 11/2006 | A47B 88/04 |
| WO | WO 2006120073 | A1 * | 11/2006 | A47B 88/04 |
| WO | 2007007950 | A1 | 1/2007 | |

* cited by examiner

REFRIGERATING DEVICE WITH TELESCOPIC EXTENSION

BACKGROUND OF THE INVENTION

The present invention concerns a refrigerating device having a body, a door and a carrier for refrigerated products, the carrier being supported on adapters anchored on movable rails of telescopic extensions and displaceable between an inserted and a withdrawn position. Such a device is known from DE10 2005 021591 A1.

The purpose of the adapter is to give a certain mobility to the carrier in relation to the telescopic rails, which is necessary due to manufacturing tolerances of the body and carrier and different thermal expansion coefficients of the materials being used, but on the other hand to ensure a reliable support for the carrier on the movable rails of the telescopic extensions, in spite of a narrow overlapping surface between these rails and the carrier.

During the operation of such a refrigerating device it can occasionally be necessary to completely remove a carrier for cleaning, for example. After disassembly of the carrier, the telescopic extensions freely project out of the body and there is a considerable risk of a user being injured on sharp edges of the rails, or soiling his/her clothing with lubricants adhering to the rails.

BRIEF SUMMARY OF THE INVENTION

The object of the present invention is to create a refrigerating device of the type stated above, in which this risk is largely eliminated without this impairing the load-carrying capacity of the adapters and the reliable support which these give to the carrier.

The object is achieved in that the movable rails of the telescopic extensions are concealed underneath a tray and that the tray of each telescopic extension is clamped between the movable rail thereof and the at least one adapter anchored thereon.

For the anchoring of the adapter or adapters to the rail, provision is preferably made for a toggle of one of the adapters which engages in a latching opening of the movable rail, to also pass through an opening in the tray.

This adapter is preferably displaceable between a first position in which the toggle can pass through the latching opening, and a second position in which an arm of the toggle projects over an edge of the latching opening. The direction of displacement of the adapter can be horizontal so that a static load of the carrier on the adapter is insignificant in relation to the position of the toggle in the latching opening; however, it can also be vertical, so that the toggle is driven into the second position by the static load on the adapter.

In order to lock the adapter in the second position, a spring-loaded projection can be provided on the adapter, which in the second position engages in a recess in the movable rail.

In order to conceal the opening of the tray penetrated by the toggle, and preferably also to clamp the tray, the adapter preferably has a plate covering the opening of the tray.

To enable the load of the carrier to be efficiently conducted into the movable rail, a cap piece of the adapter is preferably arranged above the movable rail and thus also above one top side of the tray covering the movable rail. To support the tray, a projection of the adapter can engage through an opening of the tray between the top side thereof and the movable rail.

BRIEF DESCRIPTION OF THE DRAWINGS

Further features and advantages of the invention are revealed in the following description of exemplary embodiments with reference to the attached figures, where.

DETAILED DESCRIPTION OF EXEMPLARY EMBODIMENTS OF THE PRESENT INVENTION

Figure 1:
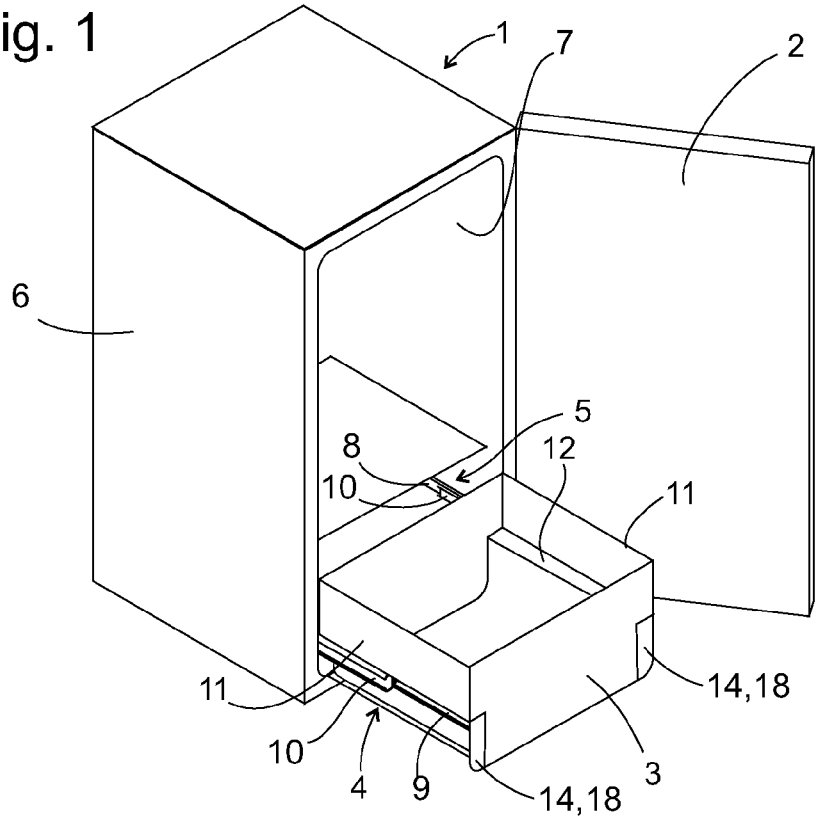
FIG. 1 shows a schematic view of a refrigerating device having a pull-out drawer guided on telescopic extensions, according to the present invention.

FIG. 1 shows a simplified perspective view of a refrigerating device having a body 1 and a door 2. The interior of said refrigerating device houses a telescopic extension arrangement with a pull-out drawer 3, shown in the pulled-out position. The pull-out drawer 3 is retained by a left-hand telescopic extension 4 and a right-hand telescopic extension 5. The telescopic extensions 4, 5 are constructed as known full extensions, with a stationary rail 8 anchored to a side wall 6 and 7, respectively, of the body 1, a rail 9 supporting and movable with the pull-out drawer 3, as well as an intermediate rail 10 which couples together the stationary rail 8 and the movable rail 9. As shown, the full extensions allow the pull-out drawers 3 to be completely withdrawn from the interior. Alternately, partial extensions could also be used.

The pull-out drawer 3 has two side walls 11, into each of which is built a horizontal shoulder 12. These shoulders 12 are supported via adapters 13 on the movable rails 9 of the telescopic extensions 4, 5. The adapters 13 can be seen in the illustration of FIG. 2, where for reasons of scale the details of the anchoring of the pull-out drawer 3 to the adapters 13 have been omitted.

Figure 2:
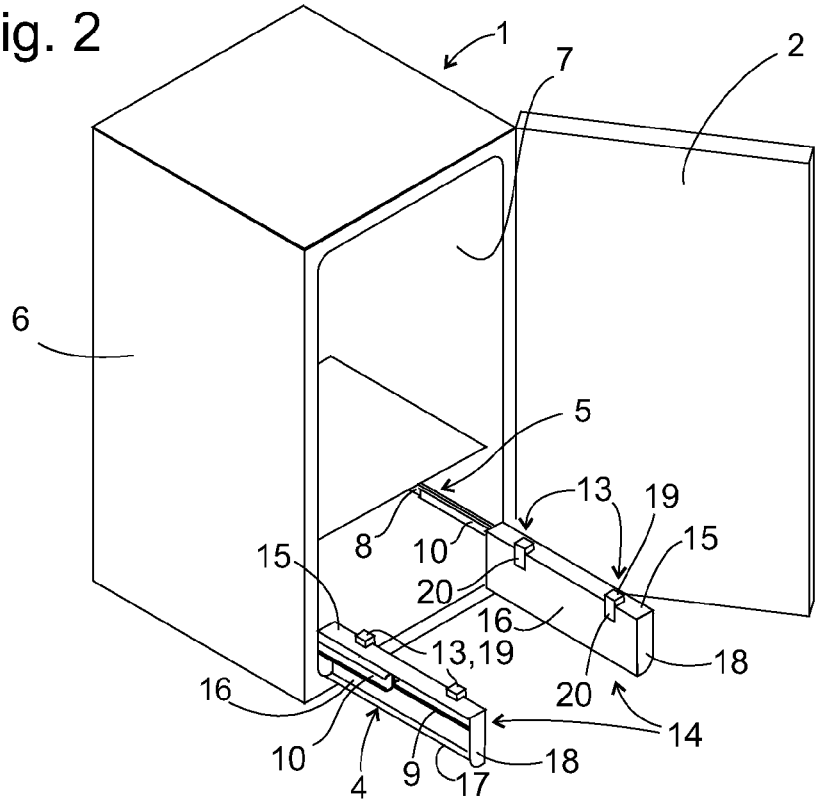
FIG. 2 shows a perspective view analogous to FIG. 1, in which the pull-out drawer is removed from the telescopic extensions.

In the illustration of FIG. 2, two trays 14 can also be seen, which wrap around the movable rails 9, except for their sides facing the respective adjacent side walls 6 and 7 of the body and a rear side facing the rear wall of the body. In each case the trays 14 are composed of an elongated sheet-metal blank which in each case forms a top side 15, a longitudinal side 16 facing the interior, and a bottom side 17 of the tray 14, and a plastic molding which forms a front side 18 facing the door and is snapped onto the sheet-metal blank.

The adapters 13 have in each case an essentially L-shaped cross-section with a cap piece 19 resting on the top side 15 of the tray 14, and a vertical plate 20 extending over the longitudinal side 16 of said tray. Each plate 20 covers two latching openings 21 of the movable rail 9, shown in FIG. 3, and with these, overlapping openings 22, shown in FIG. 4, in the longitudinal side 16 of the tray 14. Each of the latching openings 21 has the shape of a horizontal T, it being possible for a wide section of the latching opening 21 corresponding to the cross-beam of the T to be dimensioned to allow a flat T-shaped toggle 23 formed on the plate 20 to pass through. By displacing the adapter 13—in the horizontal direction in this embodiment—the foot of each toggle 23 reaches a narrower section of the latching opening 21 corresponding to the foot of the T, so that the toggle 23 is trapped in the latching opening 21 by its arms which extend over the edges of the latching opening 21.

Figure 4:
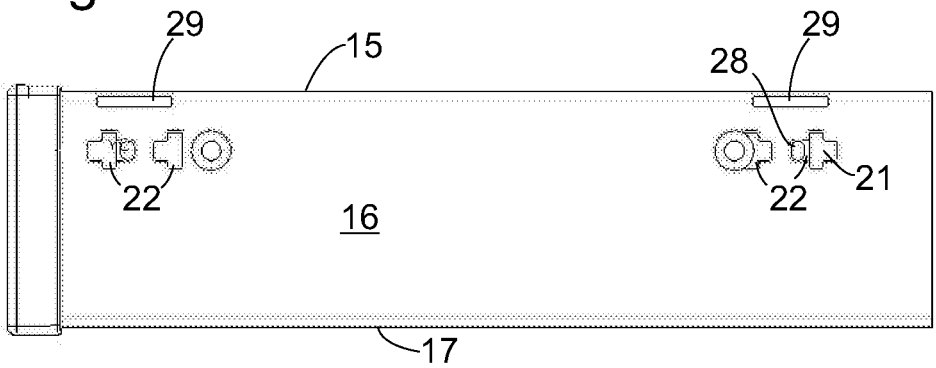
FIG. 4 shows a side view of a tray and a telescopic extension seen from the inside of the refrigerating device.

As can be seen in FIG. 4, the arrangement of locking openings 21 of the front one of the two adapters 13 mounted on one telescopic extension is a mirror image of the arrangement on the rear adapter 13, so that the displacement of the adapters 13 in their locked positions must in each case occur in opposite directions. While in the withdrawal direction the pull-out drawer 3 engages in a positive-locking manner in the latching contours 24, 25 of the adapters 13, this prevents the adapters 13 from returning in the unlocked position. At the same time this produces a control function, since correct engagement of the pull-out drawer in the contours 24, 25 of the adapters is only possible when these are at the correct distance from each other and consequently correctly located in the locked position. As long as it is impossible for the pull-out drawer to engage in the latching contours of the adapters, the pull-out drawer 3 can be pushed into the body 1 without being lowered on the telescopic extensions 4, 5 to such an extent that it collides with fixtures of the refrigerating device positioned above it.

Figure 5:
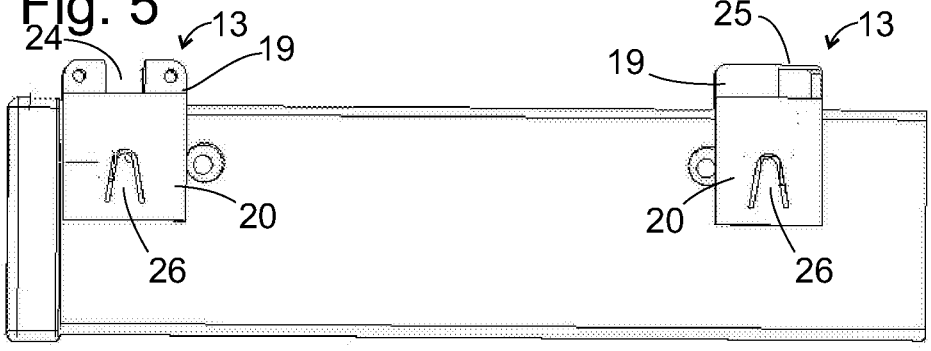
FIG. 5 shows the telescopic extension and the tray of FIG. 4 with adapters mounted thereon.

In FIG. 5, the adapters 13 are shown with different latching contours 24, 25; however, two identical adapters 13, with latching contours 24, for example, can be mounted on each telescopic extension 4, 5.

A further locking function for positional locking of the adapters 13 is realized by a flexible tongue 26 recessed into the plate 20, and which carries a latching projection 27 at its side facing the movable rail 9. As long as the toggles 23 are not latched into the latching openings 21, this latching projection 27 presses against the longitudinal side 16 of the tray 14, and the tongue 26 is flexibly deformed. As soon as the adapter 13 reaches its correct position, the latching projection 27 strikes one of the openings 22 of the tray and a latching hole 28 of the rail 9, lying behind it. While the latching projection 27 is inserted in this latching hole 28, each adapter 13 is individually locked to the rail 9.

Figure 3:
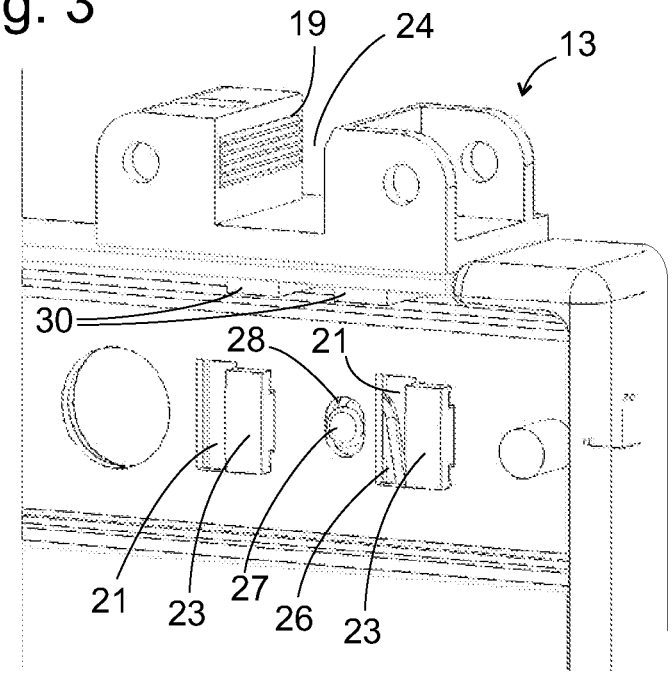
FIG. 3 shows an enlarged detailed view of a movable rail with adapter and tray.

The sheet-metal blank of the tray 14 is preferably painted before the top side 15 and the bottom side 17 are bent from the longitudinal side 16. In order to avoid damaging the paint coating during the bending operation, the radius of curvature of a bend between the sides must not be too small. Since the longitudinal side 16 of the sheet-metal blank is pressed against one longitudinal side of the movable rail 9 due to direct contact with the plate 20, because of the not inconsiderable radius of curvature it is difficult to ensure that the top side 15 of the blank rests directly on the movable rail 9 and the load of the pull-out drawer 3 is able to be transmitted to said rail. In order to avoid this problem and, in spite of the tray 14, to ensure a high carrying capacity of the adapters 13, slots 29 are formed at the positions of each of the adapters 13 at the edges between the longitudinal side 16 and the top side 15 of the sheet-metal blank, through which slots tongues 30 of the adapter 13 engage between the top side 15 and the rail 9, as can be seen in FIG. 3.

Although the top side 15 is at a distance from the movable rail 9, the load of the pull-out drawer 3 can therefore be transmitted to the rail 9 via the cap piece 19, the tongue 30 and a section of the top side 15 clamped between the cap piece 19 and the tongue 30.

The invention claimed is:

1. A refrigerating device comprising:

a body;

a door;

a pair of telescopic extension elements, each telescopic extension element being secured to the body and having a movable rail;

a carrier for refrigerated products, the carrier having lateral sides each defining a horizontally oriented shoulder;

a plurality of adapters each anchored directly to a respective one of the movable rails, the adapters securing the carrier to the movable rails of the telescopic extensions elements and the pair of telescopic extension elements being operable to permit the carrier to move outwardly relative to the body and to retract inwardly relative to the body; and a pair of covers, each cover substantially concealing at least a portion of a respective telescopic extension element, and each cover being clamped to and sandwiched between the movable rail of the respective telescopic extension element and the respective adapter anchored to the movable rail, wherein each of the shoulders directly engages a respective one of the adapters.

2. The refrigerating device as claimed in claim 1, wherein each cover is a tray.

3. The refrigerating device as claimed in claim 2, wherein one of the adapters includes a toggle that engages in a latching opening of the movable rail of the respective telescopic extension element to which the adapter is secured and the toggle passes through an opening in a tray secured to the movable rail of the respective telescopic extension element.

4. The refrigerating device as claimed in claim 3, wherein the adapter is displaceable between a first position in which the toggle can pass through the latching opening and a second position in which an arm of the toggle projects over an edge of the latching opening.

5. The refrigerating device as claimed in claim 4, wherein, in the second position, a spring-loaded projection of the adapter engages in a recess in the movable rail.

6. The refrigerating device as claimed in claim 3, wherein the adapter has a plate covering the opening of the tray.

7. The refrigerating device as claimed in claim 1, wherein each adapter has a generally L-shape; with a top part horizontally extending over a top part of the cover, and a side part that extends over a side part of the cover.

8. The refrigerating device as claimed in claim 1, wherein each of the shoulders directly engages a top side of a respective one of the adapters.

9. The refrigerating device as claimed in claim 1, wherein each of the shoulders at least partially directly contacts a top side of a respective one of the adapters.

10. The refrigerating device as claimed in claim 1, wherein each of the horizontally oriented shoulders are horizontally disposed over a top side of the adapters.

11. The refrigerating device as claimed in claim 1, wherein each of the horizontally oriented shoulders at least partially directly contacts a respective one of the adapters.

12. A refrigerating device comprising:

a body;

a door;

a pair of telescopic extension elements, each telescopic extension element being secured to the body and having a movable rail;

a carrier for refrigerated products;

a plurality of adapters each anchored directly to a respective one of the movable rails, the adapters securing the carrier to the movable rails of the telescopic extensions elements and the pair of telescopic extension elements being operable to permit the carrier to move outwardly relative to the body and to retract inwardly relative to the body; and a pair of covers, each cover substantially concealing at least a portion of a respective telescopic extension element, and each cover being clamped to and sandwiched between the movable rail of the respective telescopic extension element and the respective adapters anchored to the movable rail, wherein each cover is a tray, wherein one of the adapters includes a toggle that engages in a latching opening of the movable rail of the respective telescopic extension element to which the adapter is secured and the toggle passes through an opening in the tray secured to the movable rail of the respective telescopic extension element, wherein the adapter is displaceable between a first position in which the toggle can pass through the latching opening and a second position in which an arm of the toggle projects over an edge of the latching opening, and wherein another one of the adapters includes a toggle that engages in a latching opening of the movable rail of the respective telescopic extension element to which the adapter is secured and the toggle passes through an opening in a tray secured to the movable rail of the respective telescopic extension element, the another adapter is displaceable between a first position in which the toggle can pass through the latching opening and a second position in which an arm of the toggle projects over an edge of the latching opening, and the two adapters with toggles are secured on the same movable rail and are displaceable in opposite directions between their first and second positions.

13. A refrigerating device comprising:

a body;

a door;

a pair of telescopic extension elements, each telescopic extension element being secured to the body and having a movable rail;

a carrier for refrigerated products;

a plurality of adapters each anchored directly to a respective one of the movable rails, the adapters securing the carrier to the movable rails of the telescopic extensions elements and the pair of telescopic extension elements being operable to permit the carrier to move outwardly relative to the body and to retract inwardly relative to the body; and a pair of covers, each cover substantially concealing at least a portion of a respective telescopic extension element, and each cover being clamped to and sandwiched between the movable rail of the respective telescopic extension element and the respective adapters anchored to the movable rail, wherein each cover is a tray, wherein one of the adapters includes a toggle that engages in a latching opening of the movable rail of the respective telescopic extension element to which the adapter is secured and the toggle passes through an opening in the tray secured to the movable rail of the respective telescopic extension element, and wherein a cap piece of the adapter is arranged above one top side of the tray and a projection of the adapter engages through an opening of the tray between the top side thereof and the movable rail.

* * * * *